US006209504B1

(12) United States Patent
Hegemier et al.

(10) Patent No.: US 6,209,504 B1
(45) Date of Patent: Apr. 3, 2001

(54) HEAVY-DUTY VALVE STEM SEAL

(75) Inventors: Timothy Alan Hegemier; Mark Allen Stamback, both of Avilla, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/395,579

(22) Filed: Sep. 14, 1999

(51) Int. Cl.[7] ..... F01L 3/24
(52) U.S. Cl. ..... 123/188.6
(58) Field of Search ..... 123/188.6, 188.5, 123/188.9

(56) References Cited

U.S. PATENT DOCUMENTS

| | | | | |
|---|---|---|---|---|
| 3,699,942 | | 10/1972 | Moray . | |
| 4,834,037 | * | 5/1989 | Lafever | 123/188 P |
| 4,919,090 | | 4/1990 | Deuring et al. . | |
| 4,947,811 | | 8/1990 | Binford . | |
| 5,072,950 | | 12/1991 | Littleproud et al. . | |
| 5,174,256 | * | 12/1992 | Binford | 123/188.6 |
| 5,295,461 | * | 3/1994 | Rao et al. | 123/188.009 |
| 5,381,765 | | 1/1995 | Rhodes . | |
| 5,775,284 | | 7/1998 | Kirchner et al. . | |
| 6,119,645 | * | 9/2000 | Hesher | 123/188.6 |

OTHER PUBLICATIONS

Victor Reinz Sealing Products "Precision Engineered Valve Stem Seals for Every Engine Application" brochure, Copyright 1998.

* cited by examiner

*Primary Examiner*—Tony M. Argenbright
*Assistant Examiner*—Katrina B. Harris
(74) *Attorney, Agent, or Firm*—Rader, Fishman & Grauer PLLC

(57) ABSTRACT

An integral valve stem seal retainer and spring seat for a reduced diameter valve seal subassembly is disclosed having lower and upper portions. An annular sealing member is bonded to the upper portion of the metal retainer and an annular flange extends radially outwardly of the lower portion of the retainer to engage at least one coil of a reduced diameter valve spring. The annular sealing member further includes upper and lower portions, wherein the upper portion engages an outer surface of a valve stem while the lower portion engages a top of a thin-wall valve guide.

5 Claims, 2 Drawing Sheets

HEAVY-DUTY VALVE STEM SEAL

FIELD OF THE INVENTION

The present invention relates to internal combustion engine valve seal retainers, and more particularly to a unitary annular retainer having an integral spring seat and close clearance for use with high power density heavy-duty engines.

BACKGROUND OF THE INVENTION

In conventional overhead valve internal combustion engines, at least two valves reciprocate to provide intermittent communication between intake and exhaust manifolds and a combustion chamber. The valves include valve stems that are commonly disposed in valve stem guides, supporting axial motion in an engine component such as an engine head. Lubrication is provided to upper portions of the valve stems by a spray of lubricating oil within a valve cover disposed over the engine head or by gravity flow from an associated rocker arm. Oil flows along a free upper end of the valve stem toward the manifolds and valve heads by the force of gravity and may be encouraged by a pressure differential in the manifold versus crankcase pressure.

Annular valve stem seals are generally urged into contact with the outer surface of the valve stem and an upper portion of the valve guide by a valve stem seal retainer, and serve various purposes. First, valve stem seals minimize engine oil consumption by restricting oil entry into the manifold and the combustion chamber. Second, they help to minimize exhaust particulates that contribute to pollution. Third, they are helpful in minimizing guide wear, which is of particular importance in large diesel engines due to the nature of their operation. The valve stem, valve guide, and valve stem seals are annularly wrapped by a helical compression valve spring that serves to bias the valve into a closed position. The longitudinal ends of the valve spring are restrained by flanges on corresponding valve spring retainers and/or spring seats, thereby maintaining proper alignment and position of the valve and valve spring.

In the heavy-duty engine market a number of changes are being made to comply with recent and prospective emissions standards. As the construction of the engine changes, engine designers must nevertheless maintain a robust engine design with a sufficient level of dependability. One of the more prominent changes being implemented is the increase of the power rating of the engine in an effort to reduce the size of the engine. In particular, engine manufacturers are attempting to reduce the displacement of heavy-duty engines while still providing ample horsepower and torque for heavy-duty applications. As is well-known, engine displacement is calculated by multiplying cylinder bore area times the piston stroke length. In reducing the displacement of heavy-duty engines, manufacturers are reducing both the bore area and the stroke length while increasing the compression within the combustion chamber. Increasing the required amount of compression, in turn, places greater stress on the valve seal. Many of these engines are increasing their compression by up to 50–60 psig, which is a far greater pressure than many prior art valve seals can handle while being properly retained on a valve guide. For such cases, an integral valve seal with a metal retainer is normally recommended.

However, as the bore area of an engine is reduced, the area provided for valve assemblies above a combustion chamber is correspondingly reduced. The problem is especially significant in heavy-duty diesel engines because all valve assemblies are typically oriented perpendicular to the engine head. Additionally, a fuel injector occupies a large portion of the area above the cylinder bore. Thus, in high efficiency heavy-duty diesel engines having more than two valves (intake and exhaust valves) per cylinder, the area directly above the engine bore must be shared by a fuel injector and the valves. Since the size of the fuel injector is substantially fixed, a reduction in engine bore generally requires a reduction in the valve assembly diameter, including corresponding reductions in the diameter of valve stem seals, valve guides, and valve stem seal retainers. There is thus a need for a valve seal assembly capable of withstanding increased compression loads while providing a seal having close clearance and durability.

SUMMARY OF THE INVENTION

The present invention is directed to an integral valve stem seal retainer and spring seat for a reduced diameter valve seal assembly. The retainer includes lower and upper portions. An annular sealing member is bonded to the upper portion of the metal retainer and an annular flange extends radially outwardly of the lower portion of the retainer to engage at least one coil of a reduced diameter valve spring. The annular sealing member further includes upper and lower seals, wherein the upper seal engages an outer surface of a valve stem while the lower seal engages a top of a thin-wall valve guide. The lower portion of the retainer may include a plurality of radially inwardly extending tangs to positively engage an outer surface of the valve guide against axial and rotational movement.

The integral valve stem seal retainer and spring seat of the present invention allows a reduced diameter valve seal subassembly and provides a seal capable of withstanding high pressure while reducing wear in heavy-duty engines.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE PREFERRED EMBODIMENTS

Figure 1:
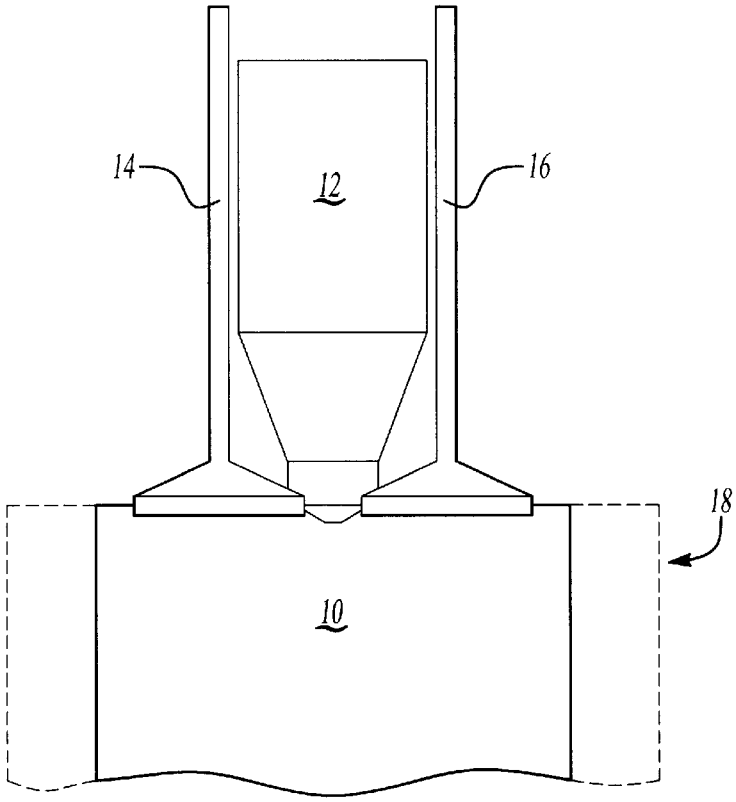
FIG. 1 is a side plan view of a cylinder bore of a heavy-duty high power density diesel engine.

As noted above, reducing the displacement of heavy-duty engines causes a corresponding reduction in a cylinder bore area. In FIG. 1, a side plan view of a reduced area cylinder bore 10 is shown. FIG. 1 also shows in plan view a fuel injector 12, and two valves 14, 16 corresponding respectively to intake and exhaust valves. As may be appreciated from FIG. 1, the valves 14, 16 extend generally perpendicular to the cross-sectional area of the cylinder bore 10, and are not angled with respect to the combustion chamber. In comparison to a conventionally sized heavy-duty engine cylinder bore, shown in phantom as reference 18, the reduced area bore 10 provides substantially less area above the bore 10 for placement of both the fuel injector 12 and the valves 14, 16.

Figure 2:
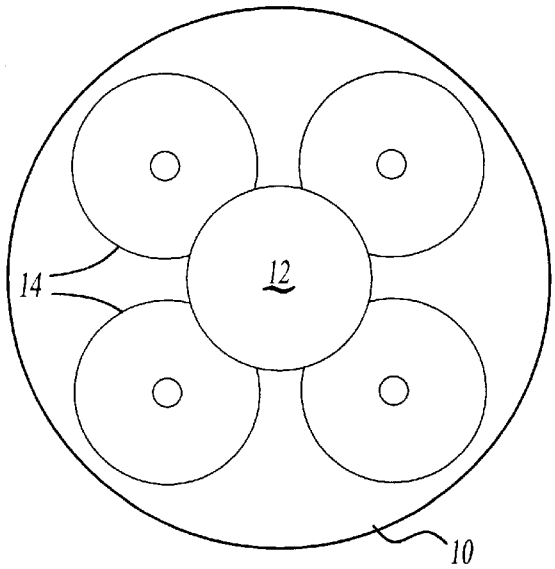
FIG. 2 is a top plan view of a cylinder bore of a heavy-duty high power density diesel engine.

The space constraints associated with heavy-duty high power density engines are further illustrated with reference to FIG. 2, which shows the reduced diameter bore 10 from the top. In FIG. 2, the fuel injector 12 shares the area directly above the cylinder bore 10 with two pairs of valve assemblies 14, 16 (two intake and two exhaust valves). Again, because the valve assemblies 14, 16 and the fuel injector 12 extend generally perpendicular to the cross-sectional area of the cylinder bore 10, the area allowed for each valve assembly 14, 16 is severely constrained. As may be appreciated, it is not practical to reduce the size of the fuel injector 12. To enable the four valve assemblies 14, 16 and the fuel injector 12 to fit within the allocated space above each cylinder bore 10, the corresponding cross-sectional area of the valve assemblies 14, 16 must be reduced.

Figure 3:
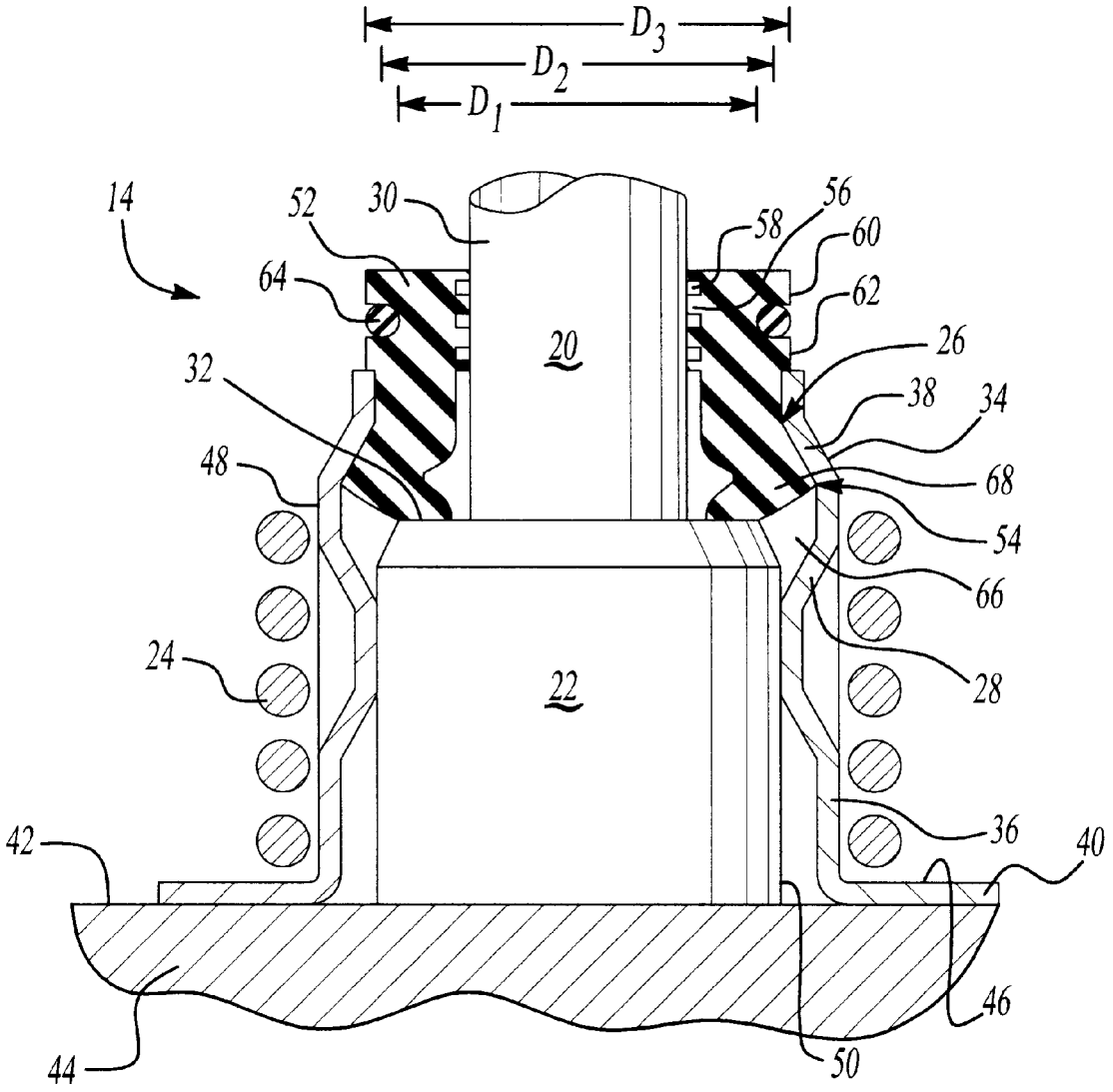
FIG. 3 is a perspective view of the valve assembly of the present invention.

One valve assembly, corresponding either to an intake valve 14 or an exhaust valve 16, is shown in FIG. 3. For purposes of the following description, the valve assembly in FIG. 3 will be referred to as an intake valve 14, but it should be understood that the following description applies to exhaust valves as well.

In general, the components that most contribute to the cross-sectional area of the valve assembly 14 include a valve stem 20, a valve guide 22, and a valve spring 24. In addition, the valve assembly further includes a valve stem seal 26 and a valve stem seal retainer 28. When assembled, the valve stem 20 is seated in and surrounded by the annular valve guide 22. In reducing the cross-sectional area of the valve assembly 14, it is generally not possible to reduce the outer diameter of the valve stem 20 for structural reasons. Instead, reducing the outer diameter of both the valve guide 22 and the valve spring 24 achieves most of the cross-sectional area reduction. However, reducing the outer diameter of the valve guide 22 results in a relatively thin-walled valve guide. It is possible that the length of the valve guide 22 might be increased to provide effective support for the valve stem 20. Unfortunately, increasing the length of the valve guide 22 results in more of the valve guide projecting above the engine head, which would require a deeper stamping operation to fabricate the valve stem seal retainer 28. Even if the length of the valve guide 22 is not increased, however, it is relatively difficult for the valve stem seal 26 to remain in constant contact with the outer circumference 30 of the valve stem 20, and also with the top portion 32 of the valve guide 22 while at the same time remaining free from interference from the valve spring 24. As seen in FIG. 3, the valve stem seal 26 is supported by the valve stem seal retainer 28. Generally, when the valve guide 22 projects upwardly a relatively large amount, the valve stem seal retainer 28 includes at least two pieces, including an upper portion for fixing the valve stem seal in place and a lower portion for preventing migration of the upper portion when the valve stem 20 reciprocates during engine operation. The lower portion may also include a flange for supporting a lower end of the valve spring 24.

However, a multiple piece valve stem seal is inappropriate when cross-sectional area of the valve assembly is critical. Instead, according to the present invention, an annular integral valve stem seal retainer 28 is shown having upper and lower portions 34, 36 respectively. The upper portion 34 of the valve stem seal retainer 28 supports and is bonded to the elastomeric valve stem seal 26 along an outer circumference 38 thereof. The inner diameter $D_1$ of the retainer upper portion 34 is less than the inner diameter $D_2$ of the retainer lower portion 36 so that the valve stem seal 26 is firmly biased radially inwardly to make contact with the outer circumference 30 of the valve stem 20. The lower portion 36 of the valve stem seal retainer 28 further includes a radially outwardly projecting annular flange 40 that acts to locate the retainer 28 against the upper surface 42 of the cylinder head 44. An upper surface 46 of the flange 40 acts as a seat for a lower end of the valve spring 24. By including the flange 40 with the valve stem seal retainer 28, the valve seal may be fabricated and installed as a single subassembly comprising the valve stem seal 26, the valve stem seal retainer 28, and the spring 24. The sealing subassembly is easier to install, especially given the space constraints above the cylinder bore as described above.

Likewise, because the retainer 28 is unitary in construction, the inner diameter $D_2$ of the retainer 28 lower portion 36 is less than if the retainer lower portion were a separate piece. Additionally, the retainer lower portion may include a plurality of radially inwardly projecting indentations or tangs 48 that act to secure the retainer to the outer surface 50 of the valve guide 22. The tangs 48 also act to prevent the valve seal retainer 28 from lifting or rotating as the valve reciprocates during engine operation.

As noted above, an annular valve stem seal 26 is bonded to the outer circumference 30 of the valve stem 20 to provide a tight seal. In practice, the valve stem seal 26 includes an upper seal 52 and a lower seal 54. The upper seal 52 includes a plurality of radially inwardly extending fingers 56 defining a number of recesses 58 in the face of the seal 26. The fingers 56 contact the outer circumference 30 of the valve stem 20 to prevent ingress of excessive amounts of lubricant, while the recesses 58 provide a reservoir of lubricant to the valve stem as well as a location for excess oil to flow. The outer circumference 60 of the upper portion 52 of the seal 26 further includes a groove 62 for receiving an o-ring 64, which prevents the seal upper portion 52 from deforming over the life of the seal.

The lower portion 54 of the valve stem seal 26 includes a frustoconical end 66 that extends axially from the upper seal to contact the top portion 32 of the valve guide. The outer diameter $D_3$ of the base 68 of the frustoconical end 66 is substantially equal to or slightly smaller than $D_2$, and is therefore greater than the inner diameter $D_1$ of the retainer upper portion 34, so that the valve stem seal 26 is tightly held against the outer circumference 30 of the valve stem 20. By configuring the valve stem seal in this manner, the amount of elastomeric material needed to create effective sealing is reduced over conventional two-piece valve stem seal assemblies, thereby allowing for a seal having a reduced diameter.

The combination of the above-described features therefore enables construction of a valve seal assembly for use with reduced diameter valve guides 22. The shape of the valve seal retainer allows an extremely small clearance T between the lower portion 36 of the retainer 28 and the outer circumference 38 of the valve guide 22. At the same time, the flange 40 on the lower portion 36 provides an integral spring seat for use with a reduced diameter valve spring 24. The valve seal subassembly of the present invention therefore provides a more compact assembly while not compromising sealability or durability of the seal.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. In a valve assembly of a heavy-duty engine, an integral valve stem seal subassembly comprising:

a reduced diameter valve spring;

a one-piece unitary metal annular valve seal retainer including upper and lower annular portions, wherein the inner diameter of said upper portion is less than the inner diameter of said lower portion, said lower portion axially extending to a height above a top portion of a valve guide, a flange extending radially outwardly of said lower portion for engaging at least one coil of said reduced diameter valve spring; and an annular sealing member having upper and lower seals, said sealing member bonded to said retainer upper portion, said upper seal including an inner circumferential surface for sealing engagement with an outer surface of a valve stem, said lower seal including a frustoconical end extending axially from said upper seal to contact said top portion of said valve guide.

2. The valve subassembly of claim 1, wherein an outer diameter of said frustoconical end is greater than said inner diameter of said retainer upper portion.

3. The valve subassembly of claim 2, where said valve guide has a reduced wall thickness.

4. The valve subassembly of claim 3, where said retainer lower portion further includes a plurality of radially inwardly extending tangs to positively engage an outer surface of the valve guide.

5. The valve subassembly as in claim 1, wherein said upper seal comprises a plurality of inwardly projecting fingers in sealing engagement with said valve stem outer surface, said fingers defining a plurality of recesses therebetween.

* * * * *